US005682715A

United States Patent [19]

McKann et al.

[11] Patent Number: 5,682,715

[45] Date of Patent: Nov. 4, 1997

[54] TWO PIECE CENTER MULL FOR MULTIPLE DOOR ASSEMBLY

[75] Inventors: H. Smith McKann, Fredericksburg; Gerald Schmidt, Jr., Spotsylvania, both of Va.

[73] Assignee: General Products Company, Inc., Fredericksburg, Va.

[21] Appl. No.: 550,097

[22] Filed: Oct. 30, 1995

[51] Int. Cl.[6] ..... E06B 1/18

[52] U.S. Cl. ..... 52/207; 49/504; 52/730.5; 52/732.2

[58] Field of Search ..... 52/207, 730.4, 52/730.5, 774.2, 731.3, 731.5, 732.2, 732.3, 732.1; 49/381, 382, 501, 506

[56] References Cited

U.S. PATENT DOCUMENTS

| | | | |
|---|---|---|---|
| 1,444,994 | 2/1923 | White . | |
| 1,894,102 | 1/1933 | Kuenzel . | |
| 2,604,195 | 7/1952 | Peremi . | |
| 2,988,183 | 6/1961 | Hallock . | |
| 3,332,197 | 7/1967 | Hinkle | 52/731.3 |
| 3,352,078 | 11/1967 | Neal | 52/731.3 |
| 3,526,074 | 9/1970 | Miller . | |
| 3,729,869 | 5/1973 | Wenig | 52/730.4 X |
| 4,167,088 | 9/1979 | Governale | 52/207 |
| 4,214,405 | 7/1980 | Chupik . | |
| 4,344,253 | 8/1982 | Stiles . | |
| 4,502,249 | 3/1985 | Banford | 52/207 X |
| 4,512,124 | 4/1985 | Banford | 49/381 X |
| 4,573,287 | 3/1986 | Hagecyer et al. | 49/381 |
| 4,760,682 | 8/1988 | King | 52/731.3 |
| 4,941,289 | 7/1990 | Rolek . | |
| 5,187,898 | 2/1993 | McKann . | |
| 5,293,723 | 3/1994 | Slessor | 49/382 X |
| 5,345,722 | 9/1994 | McKann . | |
| 5,371,987 | 12/1994 | Hirsch . | |

FOREIGN PATENT DOCUMENTS

| | | | |
|---|---|---|---|
| 1514936 | 6/1978 | United Kingdom | 52/731.3 |

*Primary Examiner*—Michael Safavi

*Attorney, Agent, or Firm*—Roylance, Abrams, Berdo & Goodman, L.L.P.

[57] ABSTRACT

A center mull for a double or multiple door assembly has a mull base and mull closure. The door assembly has a fixed inactive door and a movable active door. The mull base and mull closure are of non-wooden material. The mull base has a base end member and base sides angularly extending from opposite end edges of the base and member. The mull base is attached to the fixed door. The mull closure has a closure end member and closure sides angularly extending from opposite end edges of the closure end member. Couplings on the free ends of the base sides and closure sides attach the mull closure to the mull base.

12 Claims, 3 Drawing Sheets

TWO PIECE CENTER MULL FOR MULTIPLE DOOR ASSEMBLY

FIELD OF THE INVENTION

The present invention relates to a center mull for a double door or other multiple door assembly which can be formed of metal or other non-wooden material. More particularly, the present invention relates to a center mull for a multiple door assembly which has two pieces, a mull base which is secured to the fixed door adjacent the abutting door edges and a closure part which is coupled to the mull base.

BACKGROUND OF THE INVENTION

Double or multiple doors generally have a center mull adjacent the abutting edges of a fixed door and a movable or pivoted door. Such door assemblies are often referred to as patio doors.

The wooden center mull of conventional multiple or double door assemblies rots over time. Thus, a mull is necessary which can be easily used as a replacement on existing doors. Additionally, a center mull which will not rot is needed.

SUMMARY OF THE INVENTION

An object of the present invention is to provide a center mull for a multiple door assembly which is formed of two non-wooden parts.

Another object of the present invention is to provide a center mull which can be easily used as a replacement part in existing door systems.

A further object of the present invention is to provide a center mull for multiple door assemblies which is simple and inexpensive to manufacture, is simple and inexpensive to install, and is resistant to rotting.

The forgoing objects are basically obtained by a center mull for a double door assembly of a fixed inactive door and a movable active door comprising a mull base and a mull closure, each of non-wooden material. The mull base has a base end member and base sides angularly extending from opposite end edges of the base end member. Attachment means secures the base end member to the fixed door. The mull closure has a closure end member and closure sides angularly extending from opposite end edges of the closure end member. First and second coupling means on free ends of the base sides and the closure sides attach the mull closure to the mull base.

The foregoing objects are also obtained by a multiple door assembly comprising an outer frame, a fixed inactive door mounted in the frame, a movable active door movably mounted in the frame between open and closed positions in the frame, with the door having abutting edges. A center mull extends across the frame adjacent to and parallel to the abutting door edges, and comprises a mull base and a mull closure, each of non-wooden material. The mull base has a base end member and base sides angularly extending from opposite end edges of the base end member. Attachment means secures the base end member to the fixed door. The mull closure has a closure end member and closure sides angularly extending from opposite end edges of the closure end member. First and second coupling means on free ends of the base sides and the closure sides attach the mull closure to the mull base.

By forming the center mull and the multiple door assembly in this manner, the center mull can be formed of such non-wooden materials as metal and plastic, although metal is preferred. Parts can be easily mass produced. The mull base can be simply attached to the fixed door, for example by screws. The mull closure can then be attached to finish the center mull by merely mounting the mull closure on the mull base, although additional screws can pass through the mull closure and into the fixed door.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
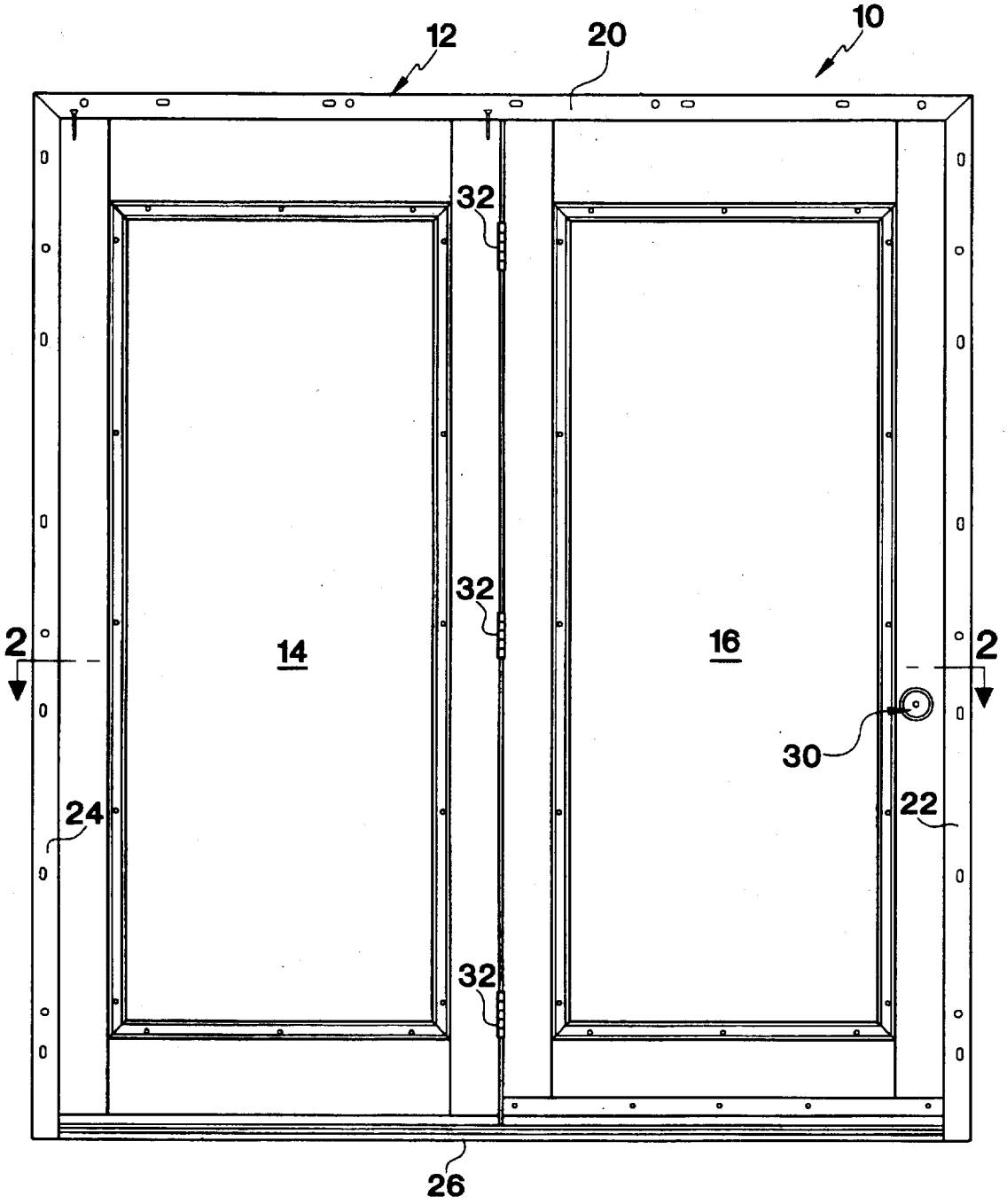
FIG. 1 is a front elevational view of multiple door assembly according to a first embodiment of the present invention.
Figure 2:
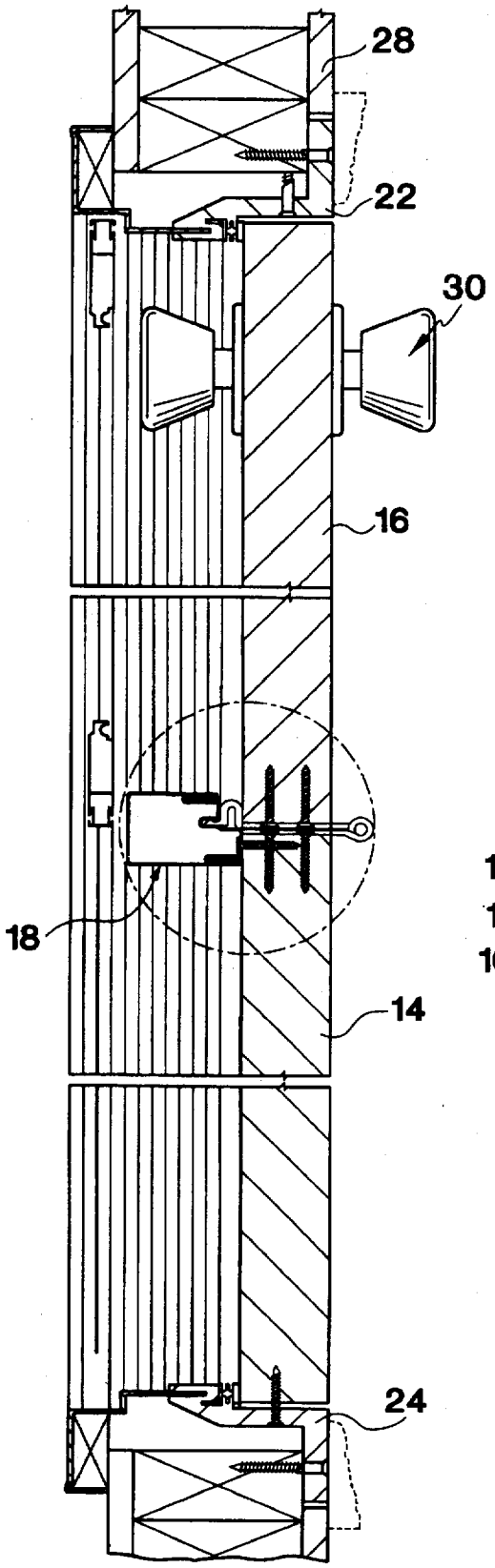
FIG. 2 is a partial top plan view in section taken along lines 2—2 of FIG. 1.

Referring initially to FIGS. 1 and 2, a multiple door assembly 10 comprises an outer frame 12, a fixed inactive door 14, and a movable, active door 16. A center mull 18 extends across frame 12 and is adjacent to and parallel to abutting edges of doors 14 and 16. The center mull is fixed to the inner surface of fixed door 14, and forms part of a hinge jamb for movable door 16.

Outer door frame 12, and doors 14 and 16 are conventional, and thus, are only briefly described. Frame 12 includes a head jamb 20, a strike jamb 22, a fixed jamb 24 and a threshold 26. The jambs and threshold extend across the top, sides and bottom of a suitably formed opening in a wall 28. The strike jamb engages the side edge of movable door 16 remote from fixed door 14. The movable door is provided with a conventional door knob and lock mechanism 30 on its side adjacent strike jamb 22.

Jambs 20, 22 and 24 can be formed as disclosed in U.S. Pat. Nos. 5,187,898 and 5,345,722 to McKann, the subject matter of each is hereby incorporated by reference.

Movable door 16 is pivotally mounted on fixed door 14 by hinges 32. Hinges 32 are located along the side edge of door 16 remote from strike jamb 22.

Figure 3:
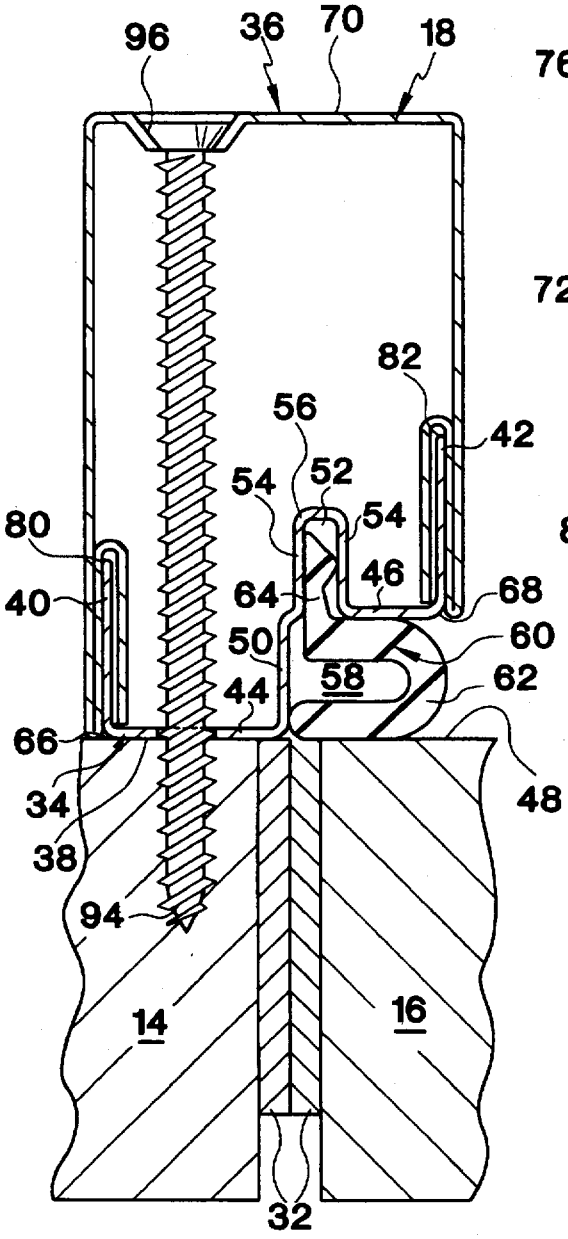
FIG. 3 is an enlarged, partial top plan view, in section, of the center mull of FIG. 2.
Figure 4:
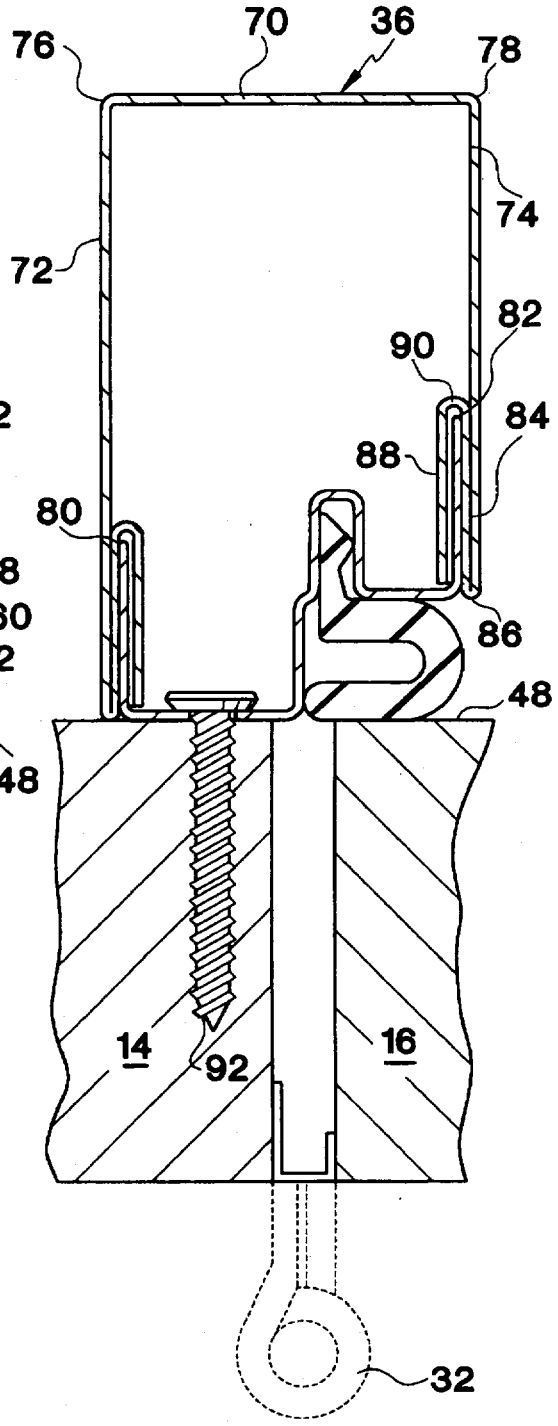
FIG. 4 is an enlarged, partial top plan view, in section, of the center mull of FIG. 2, at a different located spaced along the longitudinal length of the center mull relative to the illustration of FIG. 3.

Referring to the first embodiment of the center mull illustrated in FIGS. 3 and 4, center mull 18 comprises a mull base 34 and a closure 36. Each of the mull base and the closure base are separately formed of non-wooden material, such as metal or plastic. Preferably, as shown in the illustrated embodiments, the mull closure and mull base are formed of sheet metal which is bent to the desired and illustrated shapes. Alternatively, the mull base and closure base can be formed of metal or plastic which is extruded or molded to the required shape.

Mull base 34 comprises a base end member 38 and base sides 40 and 42. The base sides extend substantially perpendicularly from opposite end edges of the base end member. End member 38 comprises a fixed door half 44 and a movable door half 46. The two halves are parallel and are spaced in a direction perpendicular to the inner faces 48 of doors 14 and 16. Half 44 is closer to the doors then half 46. Specifically, half 44 is in direct surface-to-surface contact with inner face 48 of fixed door 14, while half 46 is spaced from inner surface 48 of movable door 16. In this manner, end member 38 spans the abutting or adjacent edges of the two doors.

Fixed door half 44 and movable door half 46 are connected by a center wall or portion 50 which is generally aligned with the joint between or abutting edges of doors 14 and 16. The movable door half is provided with a groove 52. Groove 52 is defined by two parallel spaced apart, side parts 54 and an end part 56.

The spacing of movable door half 46 of base end member 38 from the inner surface of movable door 16 provides a recess 58 along and adjacent to the hinge edge of movable door 16 for receiving a seal 60. Seal 60 has a main part 62 located in recess 58 to be compressed between movable door half 46 and movable door 16 to form a seal therebetween, and a tail part 64 engaged within groove 52 for attaching the seal to mull base 34.

Base sides 40 and 42 are perpendicular to the end member door halves 44 and 46. Base side 40 extends from fixed door half 38 along bend 66, while base side 42 extends from movable door half 46 along bend 68.

Mull closure 36 comprises a closure end member 70 and closure sides 72 and 74 extending perpendicularly from the closure end member along bends 76 and 78, respectively, located along the opposite end edges of the closure end member. Each of sides 72 and 74 and end member 70 are substantially planar. The free ends of the closure sides, i.e., those ends remote from end member 70 have slots 80 and 82 for receiving base sides 40 and 42, respectively. Each slot is defined by a first leg 84 extending along an inner surface of the closure side from a first bend 86 at the mull closure side free end, and a second leg 88 extending parallel to and spaced from first leg 84. The second leg extends from a second bend 90 at the end of the first leg remote from first bend 86. The engagement of mull base sides 40 and 42 within slots 80 and 82 of mull closure 36 provides a frictional engagement of the mull closure with the mull base.

In mounting the center mull across the frame and on fixed door 14, the mull base is initially fixed to fixed door 14 in a suitable manner, for example, by screws 92 (FIG. 4). Seal 60 can be pre-assembled with the mull base. After the mull base is secured to the fixed door, mull closure 36 is mounted on the mull base by mounting the mull closure with the mull base sides 40 and 42 being received in slots 80 and 82. In this manner, mull closure sides 72 and 74 overlie the lateral outer surfaces of the mull base to provide a more finished appearance.

To further enhance the attachment of the mull closure, screws 94 (FIG. 3) can pass through countersunk holes 96 in closure end member 70, through holes in fixed door half 44 of base end member 38 and into fixed door 44. The outer surface of the head of screw 94 can be covered with a suitable putty or other material to enhance the aesthetic appearance of the center mull.

Figure 5:
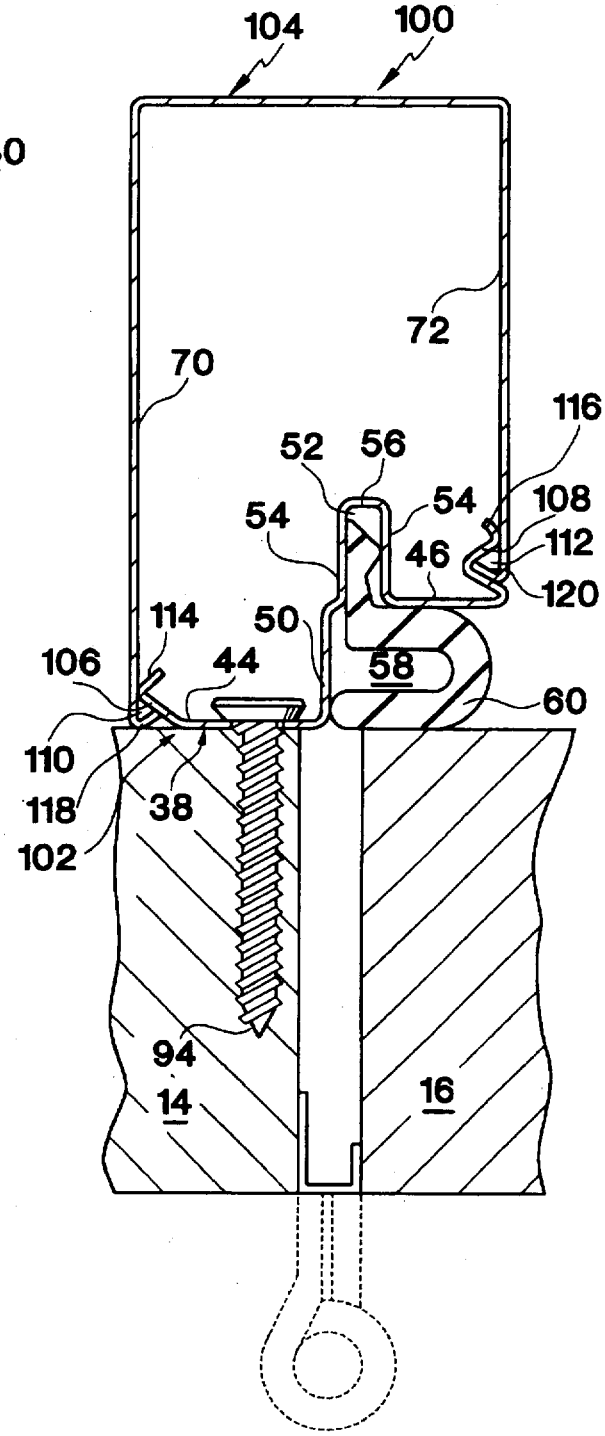
FIG. 5 is an enlarged, partial top plan view, in section, of a center mull according to a second embodiment of the present invention.

A center mull 100 according to a second embodiment of the present invention is illustrated in FIG. 5 and comprises a mull base 102 and a mull closure 104. Portions of mull base 102 and mull closure 104 which are essentially the same as the corresponding parts of the mull base and mull closure of the first embodiment are identified with like referenced numbers. The principle difference is the use of a snap coupling between the mull base and mull closure in the second embodiment, while a frictional engagement is employed between the mull base and mull closure in the first embodiment.

Mull base 102 has base end member 38 with a fixed door half 44, a movable door half 46, a center portion 50 and a groove 52 defined by parts 54 and 56. A recess 58 with a seal 60 is provided between movable door half 46 and movable door 16. Base sides 106 and 108 comprise S-shaped portions of the mull base adjacent the free ends of the base sides. The S-shaped portions define notches 110 and 112 which open laterally outwardly. The free ends of the base sides are defined by camming flanges 114 and 116. These end camming flanges angle inwardly.

The free ends edges of closure sides 70 and 72 have end flanges 118 and 120. End flanges 118 and 120 extend inwardly at acute angles relative to the respective closure sides and into notches 110 and 112, respectively, to provide a snap fit engagement between the mull closure and the mull base.

Mull base 102 is mounted on fixed door 14 by screws 94 in the same manner as the first embodiment. After proper mounting of the mull base, mull closure 104 is snapped into engagement on the mull base. During this snap engagement, end flanges 118 and 120 initially engage end camming flanges 114 and 116, respectively. The engagement of the flanges causes the mating parts to deflect in lateral directions to enable the end flanges to pass into the and mate with the notches. Screws 94 passing through the mull closure, mull base and fixed door, like screws 94 in the first embodiment, can also be used in the second embodiment. Like the first embodiment, the mull closure sides overlie the outer surfaces of the mull base sides to provide a more finished appearance.

While various embodiments have been chosen to illustrate the invention, it will be understood by those skilled in the art that various changes and modifications can be made therein without departing from the scope of the invention as defined in the appended claims.

What is claimed is:

1. A center mull for a double door assembly of a fixed inactive door and a movable active door, comprising:

a mull base of non-wood material having a base end member and base sides extending substantially perpendicularly from opposite end edges of said base end member;

attachment means for securing said base end member to the fixed door;

abutment means, on said base end member, for engaging an edge of a movable door;

a mull closure formed of sheet metal having a closure end member and closure sides extending substantially perpendicularly from opposite end edges of said closure end member; and first and second coupling means on free end edges of said base sides and said closure sides attaching said mull closure to said mull base, said coupling means including slots formed in one set of said sides which receive end portions of another set of said sides, said slots being formed in said closure sides and extending parallel to said closure sides, said slots being defined between first legs extending along said closure sides from first bends at said free ends of said closure sides and second legs extending parallel and spaced from said first legs from second bends at ends of said first legs remote from said first bends.

2. A center mull according to claim 1 wherein said base end member comprises a fixed door half and a movable door half, said halves being parallel, said fixed door half being spaced from said movable door half to define a recess between said halves; and a seal is mounted in said recess.

3. A center mull according to claim 2 wherein said fixed door half and said movable door half are connected by a center portion extending substantially parallel to said base sides; and said movable door half comprises a groove, opening into said recess, receiving and retaining a part of said seal.

4. A center mull according to claim 1 wherein said free ends of said base sides comprise planar portions received in said slots.

5. A center mull according to claim 1 wherein said closure sides overlie outer surfaces of said base sides.

6. A multiple door assembly, comprising:

an outer frame, a fixed, inactive door mounted in said frame, a movable, active door movably mounted in said frame between open and closed positions in said frame, said doors having abutting door edges; and a center mull extending across said frame adjacent to and parallel to said abutting door edges, said center mull including a mull base of non-wooden material having a base end member and base sides angularly extending from opposite end edges of said base end member, attachment means securing said base end member to said fixed door, a mull closure of non-wooden material having a closure end member and closure sides angularly extending from opposite end edges of said closure end member, and first and second coupling means on free end edges of said base sides and said closure sides attaching said mull closure to said mull base.

7. A multiple door assembly according to claim 6 wherein said base end member comprises a fixed door half and a movable door half, said halves being parallel, said fixed door half being spaced from said movable door half with said fixed door half being closer to said doors to define a recess between said halves, said fixed door half and said movable door half being connected by a center portion extending substantially parallel to said base sides, said movable door half having a groove opening into said recess; and seal is mounted in said recess.

8. A multiple door assembly according to claim 6 wherein said base sides extend substantially perpendicularly from said base end member;

said closure sides extend substantially perpendicularly from said closure end member; and said coupling means comprise slots formed in one set of said sides which receive end portions of another set of said sides.

9. A multiple door assembly according to claim 8 wherein said mull closure is formed of sheet metal, said free ends of said base sides having planar portions received in said slots; and said slots are defined between first legs extending along said closure sides from first bends at said free ends of said closure sides, and second legs extending parallel and spaced from said first legs from second bends at ends of said first legs remote from said first bends.

10. A multiple door assembly according to claim 6 wherein said mull base and said mull closures are formed of sheet metal;

said base sides have generally S-shaped portions adjacent free ends thereof to define notches and end camming flanges; and said closure sides comprise end flanges extending at acute angles relative to said closure sides and received in said notches.

11. A multiple door assembly according to claim 10 wherein said notches open laterally outwardly; and said end flanges extend laterally inwardly.

12. A multiple door assembly according to claim 6 wherein said closure sides overlie outer surfaces of said base sides.

* * * * *